US005340611A

United States Patent [19]

Kustermann et al.

[11] Patent Number: 5,340,611

[45] Date of Patent: Aug. 23, 1994

[54] PROCESS FOR COATING TRAVELLING WEBS

[75] Inventors: Martin Kustermann; Hans-Peter Sollinger, both of Heidenheim, Fed. Rep. of Germany

[73] Assignee: J. M. Voith GmbH, Heidenheim, Fed. Rep. of Germany

[21] Appl. No.: 631,375

[22] Filed: Dec. 20, 1990

Related U.S. Application Data

[63] Continuation-in-part of Ser. No. 385,212, Jul. 25, 1989, Pat. No. 4,980,207.

[30] Foreign Application Priority Data

Jan. 26, 1990 [DE] Fed. Rep. of Germany ..... 4002256

[51] Int. Cl.[5] ..... B05D 3/12

[52] U.S. Cl. ..... 427/361; 427/402; 427/411; 427/412; 427/428

[58] Field of Search ..... 427/411, 428, 412, 402, 427/361

[56] References Cited

U.S. PATENT DOCUMENTS

| | | | |
|---|---|---|---|
| 2,582,407 | 1/1952 | Barrett et al. | 117/111 |
| 2,937,955 | 5/1960 | Loomer | 427/428 |
| 3,202,536 | 8/1965 | Brezinski | 427/414 |
| 3,756,842 | 9/1973 | Meyers et al. | 427/428 |
| 4,301,210 | 11/1981 | Yasuda et al. | 427/411 |
| 4,841,903 | 6/1989 | Bird | 427/411 |
| 4,980,207 | 12/1990 | Sollinger | 427/402 |
| 5,028,457 | 6/1991 | Kinose et al. | 427/428 |

FOREIGN PATENT DOCUMENTS 882640 10/1971 Canada .

*Primary Examiner*—Shrive Beck
*Assistant Examiner*—Benjamin L. Utech
*Attorney, Agent, or Firm*—Baker & Daniels

[57] ABSTRACT

In a process for the coating of a running web of paper or cardboard, provisions are that in a press gap formed between two rolls a coating substance applied in a very small quantity on the surface of the one roll is first pressed on the web leaving a very thin coat on the web which, however, covers all spots including the "mounds" of microroughness. Next, the second coat can be applied and dosed on the still moist first coat with the usual means. In the process, the first coat is preferably dosed on the shell of the first roll, by means of the peripheral grooves of a rotary doctor. The same may be performed also as regards the second coating on the web.

10 Claims, 2 Drawing Sheets

PROCESS FOR COATING TRAVELLING WEBS

CROSS-REFERENCE TO RELATED APPLICATIONS

This application is a Continuation-In--Part of application Ser. No. 385,212 filed Jul. 25, 1989, now U.S. Pat. No. 4,980,207.

BACKGROUND OF THE INVENTION

The invention concerns a process for coating running webs of paper or cardboard where two coats are applied in direct succession, one upon the other, while the first coat is still moist. For both the first and second coatings there is at least one rotatable roll provided for support of the web, and at least the second coat is applied and dosed directly on the web. The invention also concerns appropriate applicator devices.

A process for coating running webs with two successive coating operations, where the first coat is still moist as the second is applied, is known from the U.S. Pat. No. 3,202,536. The two coating stations are both arranged on a single roll guiding the web and on two successive rolls. A so-called airbrush is used as a final smoothing element. An applicator device of appropriate kind with a roll supporting the web on a coating device is known also from the Canadian Patent Document 882,640. In this case, the coat is applied by means of an applicator roll and scraped off by a doctor blade. A mixture for the coating substance is used that consists of a kaolin substance as well as starch, protein or thermoplastic synthetic resin. U.S. Pat. No. 3,202,536, provides that the first application coat has a relatively high consistency, i.e., with a solid substance content of more than 55%, while the second coat has a considerably lower consistency with a lower solid substance content of maximally 45%, where the major share is always kaolin.

Due to the high speeds in coating, using an airbrush is very problematic today; the airbrush can practically be used only up to speeds of 500 m/min. Considering the competitive pressures existing today, this can be a grave disadvantage, although the airbrush has the great advantage that with it a flawless coating can be achieved despite a relatively sparing application.

The problem underlying the invention is to propose a device and a process with which a flawless coating of a web can be achieved. This is true especially for use with cardboard, where the surface roughness of the base cardboard is relatively great, and where other coating processes, for instance such using a blade as equalizing element, may ensue bare spots at the protruding "mounds".

SUMMARY OF THE INVENTION

According to the present invention, the coating substance is practically in the first coating application pressed on the web from the surface of the first web support roll, by means of the pressure prevailing in the press gap formed between the two interacting rolls, which certainly involves a brief deformation of the paper web. The applied or transferred amount is relatively low, and at that, in such a way that a remaining behind of solid substance particles of the coating substance is assured also on the "mounds" of microroughness. The contact pressure and the hydraulic pressure in the press gap causes a certain dewatering of the coating substance of the first coat, but the moisture content of the coating substance is retained. The "pre-dewatering" in the press gap ensures the adherence of the coating substance everywhere on the web, also on the "mounds". A certain intermediate drying before the application of the second coat is possible.

For the coating of cardboard it has been demonstrated to be favorable to only dose the second application coat by means of the grooves of a rotary doctor provided with peripheral grooving, without acting on the coat with another smoothing element. With proper adjustment of the consistency of the coating substance, a sufficient spreading is accomplished, making an additional smoothing unnecessary, which might be associated with scrape-off disadvantages.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
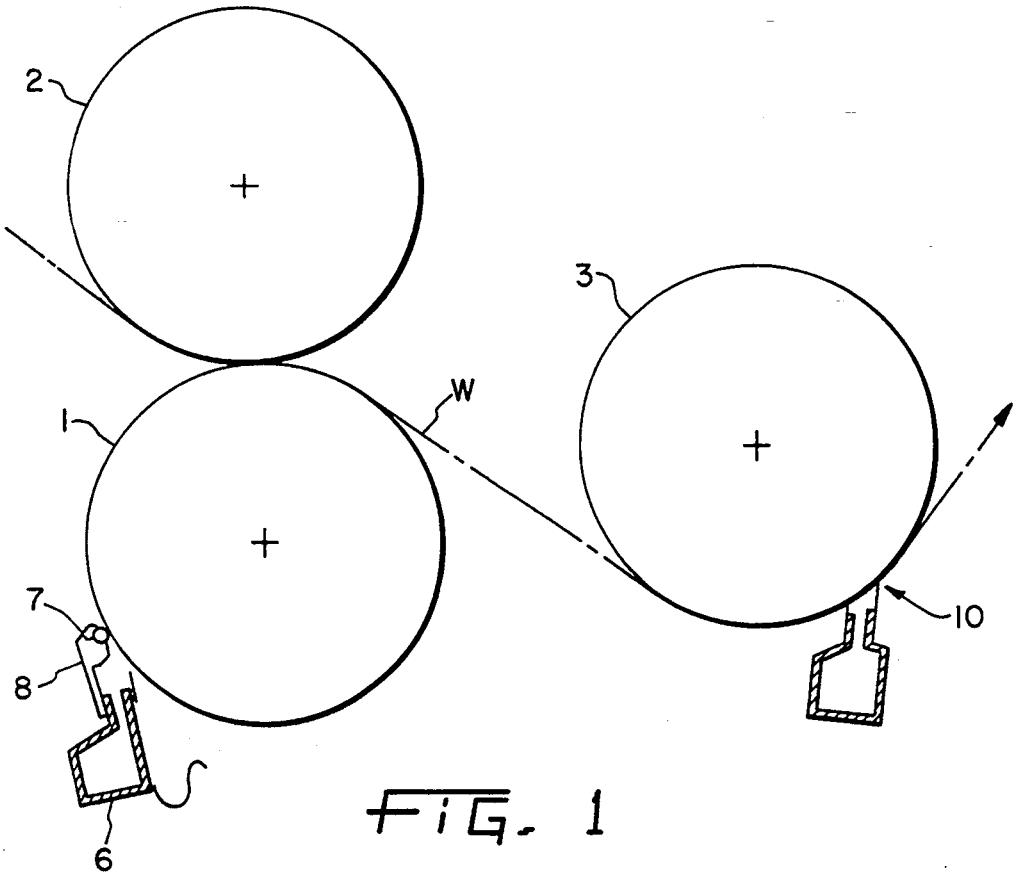
FIG. 1 is an apparatus for coating a running web of paper or cardboard in accordance with the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

According to FIG. 1, the web W runs through a press gap formed between two rolls 1 and 2. Coordinated with roll 1, which is provided with a rubberized surface, is an applicator mechanism that features a nozzle chamber 6 and, on its discharge end, a rotary doctor 7 provided with peripheral or helical grooving and a holder 8 for the latter. The hardness of the rubber coating of roll 1 may range between 0 and 200, preferably 10 and 70 Pucey and Jones (Pu.J). The amount of coating applied in the first coating layer in the case of cardboard is dimensioned to be 6 to 40 ml/m$^2$ preferably 12 to 22 ml/m$^2$. The second coat may be applied using a comparable arrangement with rotary. doctor 11 and its holder 12, along with a nozzle chamber 9, but where the equalizing element may also be a blade or a smooth rotary doctor at the point 10.

The applicable consistencies, i.e., solid substance contents, range for the first coat between 50 and 70% maximum, and for the second coat between 60 and 70% maximum. It has been found to be favorable to provide for the applicator mechanism a nozzle chamber 6, 9 on the discharge end of which, near the surface to be coated, a rotary doctor 7, 11 with its holder 8, 12 is arranged. Thus, the advantage here is, over the airbrush method, that the process may be performed with a relatively high consistency overall, but especially for the second coat. The line pressures in the press gap between the two first rolls 1 and 2 range between 5 and 60 kN/m, preferably 20 to 40 kN/m.

Figure 2:
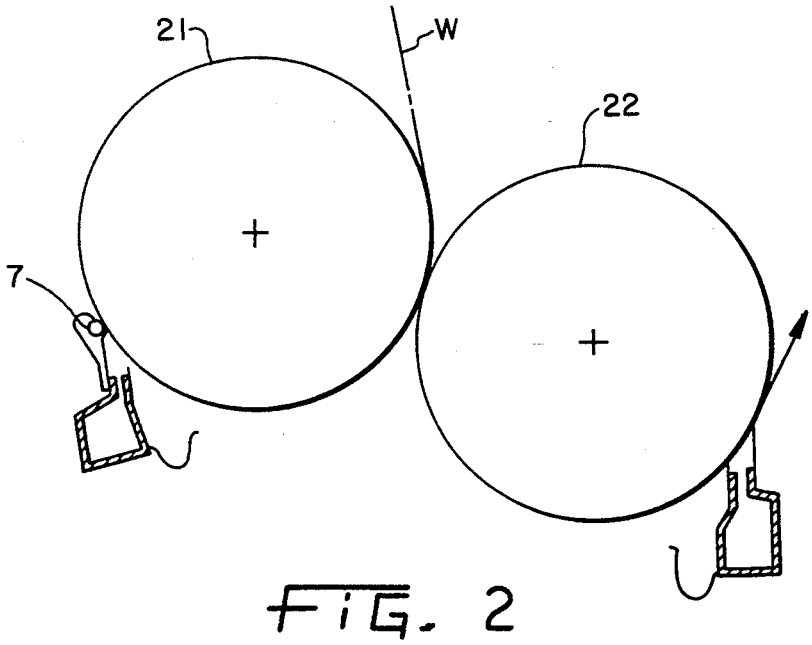
FIG. 2 is an alternate embodiment of the coating apparatus of the present invention wherein only two rolls are utilized.

The setup according to FIG. 2 has totally only two web support rolls 21 and 22, with an applicator device of the described type coordinated with each. This arrangement is possible in the case of cardboard because it stretches less than paper due to the moistening in the coater.

Figure 3:
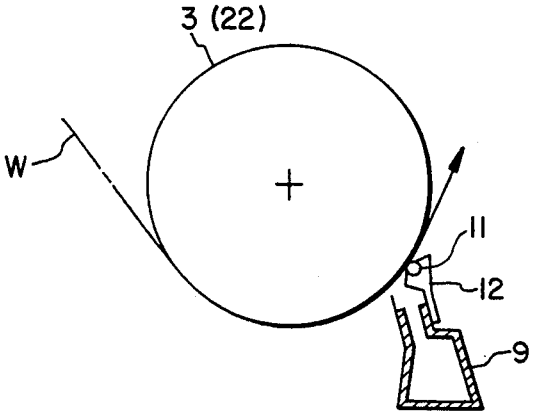
FIG. 3 is another embodiment of the coating apparatus of the present invention wherein a rotary doctor provided with peripheral grooving is provided as a dosing element for the final dosing.

A favorable option in the case of cardboard is providing on the leaving end of the nozzle chamber 9 as dosing element for the second coat (final dosing) a rotary doctor 11 provided with peripheral grooving and a holder 12, and to omit a further smoothing element thereafter. This is illustrated in FIG. 3. With this setup, a very good coating can be obtained at relatively sparing use of coating substance.

Figure 4:
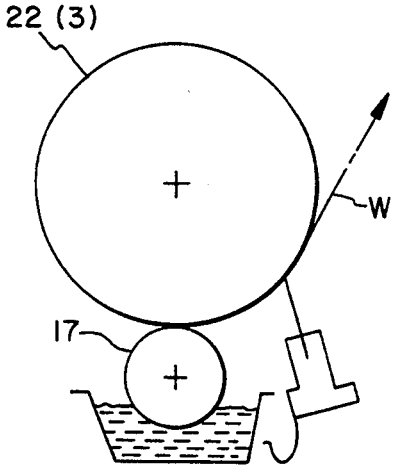
FIG. 4 is a further embodiment of the present invention wherein a transfer roll is utilized to apply the coating substance.

Illustrated additionally, in FIG. 4, for the second coating device is a transfer roll 17 for the coating substance that may be used as well. A scraping by means of one of the known dosing elements is to be provided thereafter.

In a specific application area, in the case of sizing application for paper, it is possible to dose the first coat also with a blade or a suitable lath, instead of a rotary doctor provided with grooves, but the action of the blade needs to be very closely monitored here.

Figure 5:
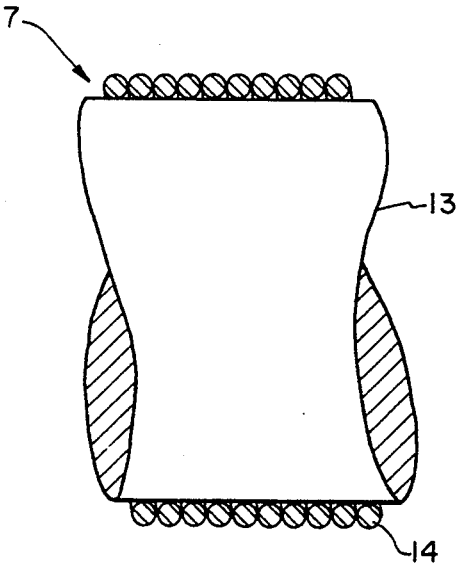
FIG. 5 is a partial sectional view of a rotary doctor according to the present invention showing the grooves between the wire threads.

FIG. 5 shows a rotary doctor according to an embodiment of the present invention, wherein the rotary doctor is provided with peripheral or helical grooving. In FIG. 5, a wire wrap has wire threads 14 that are threaded onto a cylindrical bar 13 as a core of the doctor.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process for coating a running web of paper or cardboard, comprising:

providing at least one rotatable roll having a shell surface for the support of the web during a first coating process;

providing at least one rotatable roll for the support of the web during a second coating process;

applying by way of a rotary doctor to the shell surface of the rotatable roll of the first coating process a small dosed quantity of a first coating substance, said rotary doctor having closely adjacent fine peripheral grooves or helical grooves, said first coating substance having a solid or pigment substance content, said solid substance content being maximally 70%;

passing the web through a press gap formed between a backing roll and the rotatable roll of the first coating process wherein the dosed quantity of the first coating substance is pressed on the web as it passes through the press gap so that at least a thin layer of said first coating substance covers the web, specifically with regard to said solid or pigment content; and applying a second coating substance to the web during said second coating process, at least said second coating substance being dosed and applied directly on the web, wherein said second coating substance is applied in direct succession to the first layer one upon the other while the first layer is still moist.

2. The process of claim 1, wherein said solid substance content of the first coating substance ranges between 50% and 60%.

3. The process of claim 1, wherein the quantity of first coating substance applied in the first coating layer amounts to between 6 and 40 $ml/m^2$.

4. The process of claim 3, wherein said quantity of first coating substance amounts to between 12 and 22 $ml/m^2$.

5. The process of claim 1, wherein the second layer of coating substance is dosed on the roll supporting the web during the second coating process by a rotary doctor provided with peripheral grooves, whereafter the web is deflected by said support roll, said second coating substance having a solid substance content amounting to maximally 70%.

6. The process of claim 5, wherein said solid substance content of the second coating substance ranges between 60% and 70%.

7. The process of claim 1, wherein the second coating substance has a solid substance content that is at least 10% higher, in absolute terms, than the solid substance content of the first coating substance.

8. The process of claim 1, wherein the process is applied in the manufacture of coated cardboard.

9. The process of claim 1, in which line pressures are generated in said press gap between the backing roll and the rotatable roll, wherein said line pressures range between 5 and 60 kN/m.

10. The process of claim 9, wherein said lines pressures range between 20 and 40 kN/m.

* * * * *